US009364699B2

(12) United States Patent
Gordon

(10) Patent No.: US 9,364,699 B2
(45) Date of Patent: Jun. 14, 2016

(54) INFLATABLE RECREATION DEVICE

(71) Applicant: Donald W. Gordon, Springville, UT (US)

(72) Inventor: Donald W. Gordon, Springville, UT (US)

( * ) Notice: Subject to any disclaimer, the term of this patent is extended or adjusted under 35 U.S.C. 154(b) by 8 days.

(21) Appl. No.: 14/099,450

(22) Filed: Dec. 6, 2013

(65) Prior Publication Data

US 2015/0157888 A1 Jun. 11, 2015

(51) Int. Cl.

| | |
|---|---|
| ***A63B 69/00*** | (2006.01) |
| ***A63B 5/11*** | (2006.01) |
| ***A63G 9/00*** | (2006.01) |
| ***A63G 29/00*** | (2006.01) |
| ***A63G 31/12*** | (2006.01) |
| ***A63B 19/02*** | (2006.01) |
| *A63B 7/02* | (2006.01) |

(52) U.S. Cl.

CPC . *A63B 5/11* (2013.01); *A63B 19/02* (2013.01); *A63G 9/00* (2013.01); *A63G 29/00* (2013.01); *A63G 31/12* (2013.01); *A63B 7/02* (2013.01); *A63B 2208/12* (2013.01); *A63B 2209/10* (2013.01); *A63B 2210/50* (2013.01); *A63B 2225/62* (2013.01)

(58) Field of Classification Search

USPC ..... 446/71, 220, 221; 434/247; 472/118–125; 482/27, 29

See application file for complete search history.

(56) References Cited

U.S. PATENT DOCUMENTS

| | | | | |
|---|---|---|---|---|
| 947,446 | A | | 1/1910 | Lenz |
| 1,190,743 | A | | 7/1916 | Fageol |
| 1,838,086 | A | | 12/1931 | Farnstrom |
| 2,173,963 | A | | 9/1939 | Eubank |
| 2,724,843 | A | | 11/1955 | Kimball |
| 2,813,299 | A | | 12/1957 | Holladay |
| 2,816,299 | A | | 12/1957 | Holladay |
| 3,000,022 | A | | 9/1961 | Cathey et al. |
| 3,080,584 | A | * | 3/1963 | Brown ..... 441/67 |
| 3,083,979 | A | | 4/1963 | Boyd |
| 3,125,377 | A | * | 3/1964 | Bridges ..... 297/462 |
| 3,130,816 | A | | 4/1964 | Wright |
| 3,460,828 | A | | 8/1969 | Curlee |
| 3,464,718 | A | | 9/1969 | Fisher |
| 3,537,726 | A | | 11/1970 | Conover |
| 3,664,290 | A | | 5/1972 | Finn |
| 3,779,201 | A | | 12/1973 | Spahn |
| 3,806,156 | A | | 4/1974 | Tidwell |
| 3,905,617 | A | | 9/1975 | Smith |
| 3,934,291 | A | | 1/1976 | Hagen |
| 4,014,540 | A | * | 3/1977 | Caulkins ..... 472/14 |
| 4,042,252 | A | | 8/1977 | Winter |
| 4,154,188 | A | | 5/1979 | Flagg |
| D259,652 | S | * | 6/1981 | Ahrens ..... D21/824 |

(Continued)

*Primary Examiner* — Kurt Fernstrom

(74) *Attorney, Agent, or Firm* — Thorpe North & Western, LLP

(57) ABSTRACT

An inflatable recreation device is formed of a plurality of inflatable donut-shaped tubular members secured in stacked configuration and having an opening extending therethrough. With a first end of the plurality of stacked members facing upwardly, a rebound surface secured to the first end extends over a first end of the opening to form a rebound surface upon which a user can jump. When the device is turned over, the rebound surface faces downwardly to form a bottom of the opening and a second end of the plurality of stacked members and the opening face upwardly whereby users can sit around the second end of the stacked members with feet extending into the opening, or can walk around the second end as a balance beam. Further, the stacked members can be turned on their side and rolled with users inside the opening.

20 Claims, 5 Drawing Sheets

(56) References Cited

U.S. PATENT DOCUMENTS

| | | | | | |
|---|---|---|---|---|---|
| 4,298,197 | A | | 11/1981 | Flagg | |
| 4,364,579 | A | | 12/1982 | Fisher | |
| 4,401,314 | A | | 8/1983 | Zimmerman | |
| 4,458,895 | A | | 7/1984 | Turcotte | |
| 4,576,375 | A | * | 3/1986 | Roberts | 482/27 |
| 4,598,904 | A | | 7/1986 | Roth | |
| 4,729,446 | A | | 3/1988 | Sefton | |
| 4,935,970 | A | * | 6/1990 | Aristone | 4/488 |
| 5,020,465 | A | | 6/1991 | Langford | |
| D335,164 | S | | 4/1993 | Lee | |
| D335,165 | S | | 4/1993 | Lee | |
| 5,219,309 | A | | 6/1993 | Hart | |
| D338,926 | S | | 8/1993 | Welch, Sr. | |
| D347,248 | S | | 5/1994 | Franzman | |
| 5,570,480 | A | * | 11/1996 | Yeung | 4/487 |
| 5,575,738 | A | * | 11/1996 | Millington et al. | 482/35 |
| 5,637,057 | A | * | 6/1997 | Collura | 482/27 |
| D383,504 | S | * | 9/1997 | Millington et al. | D21/803 |
| 5,669,858 | A | | 9/1997 | Blair et al. | |
| D392,012 | S | | 3/1998 | Loiselle et al. | |
| 5,813,946 | A | | 9/1998 | Lin et al. | |
| 5,897,409 | A | | 4/1999 | Hartman et al. | |
| 6,077,138 | A | | 6/2000 | Schulze | |
| 6,164,237 | A | | 12/2000 | Coryell et al. | |
| 6,220,908 | B1 | * | 4/2001 | Peterson | 441/66 |
| D451,975 | S | | 12/2001 | Gordon | |
| 6,368,226 | B1 | | 4/2002 | Gibson | |
| 6,402,627 | B1 | * | 6/2002 | Gordon | 472/114 |
| 6,595,861 | B1 | * | 7/2003 | Morrow et al. | 472/134 |
| 6,659,914 | B2 | | 12/2003 | Plante | |
| 6,685,520 | B1 | | 2/2004 | Wiggins | |
| 6,702,686 | B1 | * | 3/2004 | Brown | 472/118 |
| 6,709,340 | B2 | | 3/2004 | Gordon | |
| 6,786,495 | B1 | | 9/2004 | Browning | |
| 6,981,706 | B1 | * | 1/2006 | Kramer | 280/21.1 |
| D520,589 | S | | 5/2006 | Peterson | |
| 7,314,399 | B2 | * | 1/2008 | Turner | 441/129 |
| 7,682,259 | B1 | | 3/2010 | Edwards | |
| 7,722,506 | B2 | * | 5/2010 | Pratson et al. | 482/52 |
| 7,833,132 | B2 | * | 11/2010 | Hylbert et al. | 482/27 |
| D663,374 | S | | 7/2012 | Peterson | |
| 8,460,161 | B2 | * | 6/2013 | Cole et al. | 482/52 |
| 8,632,440 | B2 | * | 1/2014 | Pratson et al. | 482/52 |
| 2002/0182951 | A1 | | 12/2002 | Soares | |
| 2005/0148433 | A1 | * | 7/2005 | Wang et al. | 482/27 |
| 2012/0244997 | A1 | * | 9/2012 | Thompson | A63B 5/11 482/27 |
| 2013/0316876 | A1 | * | 11/2013 | Publicover | A63B 5/11 482/27 |
| 2014/0148319 | A1 | * | 5/2014 | Richter | A61G 13/009 482/142 |

* cited by examiner

INFLATABLE RECREATION DEVICE

BACKGROUND

1. Field of the Invention

The invention is in the field of inflatable recreation devices formed, at least in part, by an inflatable donut-shaped tubular member.

2. Related Art

Inflatable donut-shaped tubular members, such as those commonly referred to as inner tubes, have long been used as flotation devices for water play. Such inflatable donut-shaped tubular members have also been used to form the supporting base of trampolines, such as shown in U.S. Pat. Nos. 3,130,816, 4,576,375, and 6,659,914, wherein a rebound surface extends over the top of the opening of the donut-shaped tubular member forming the base to provide the trampoline, and U.S. Pat. No. 5,813,946 wherein the rebound surface is formed by an inflatable floor extending across the bottom of the opening of the donut-shaped tubular member forming the base. U.S. Pat. No. 7,722,506 shows a step exercise device with a base formed of two stacked inflatable donut-shaped tubular members and a rigid top plate extending over the top of the upper donut-shaped tubular member and the opening therein so that the rigid top plate forms the top surface of the step. The step is used for performing step exercises or forms a platform, which may be unsteady, upon which a user can stand to perform other exercises or play games. All of the above devices are formed as the particular devices indicated, i.e., as a trampoline or as a step exercise device. They are not usable for a plurality of activities or to form a plurality of different recreational devices.

SUMMARY OF THE INVENTION

According to the invention, an inflatable recreation device of the invention can be formed by a plurality of inflatable donut-shaped tubular members secured together in stacked configuration to form a plurality of different devices having different recreational uses. For example, the plurality of stacked inflatable donut-shaped tubular members can form the base of a trampoline having a rebound surface secured to a first end of the stack of the inflatable donut-shaped tubular members to extend over a first end of the opening extending through the inflatable donut-shaped tubular members, in a manner similar to the trampolines of the prior art. When used as a trampoline, the stack of the inflatable donut-shaped tubular members is oriented with its first end facing upwardly so that the rebound surface extending over the first end of the opening is at the top of the stack of inflatable donut-shaped tubular members forming the base. When not used as a trampoline, the stack of the inflatable donut-shaped tubular members can be turned over so that the rebound surface extending over the first end of the opening is facing downwardly at the bottom of the stack, with the second end of the of the stack of the inflatable donut-shaped tubular members facing upwardly with the second end of the opening extending through the inflatable donut-shaped tubular members open at the top of the stack. In this position, the device can be used as a gathering place with users sitting on the upwardly facing second end of the stacked inflatable donut-shaped tubular members facing one another with their legs and feet extending into the opening through the stack of inflatable donut-shaped tubular members. Further, users can walk along the top surface of the stack of inflatable donut-shaped tubular members in an exercise of balance. A balance beam marking can be provided around this top surface to guide the user. Depending upon the material from which the inflatable donut-shaped tubular members are formed, the balance beam marking can be formed of a non-slip material. In addition, in this position of the inflatable donut-shaped tubular members with the opening therethrough open at the top, users can climb inside the opening with the trampoline rebound surface forming a floor, and play within the opening. If desired, a play or bouncing structure, such as a smaller sized device of the invention or an air filled cylindrical structure, can be inserted into the opening to provide a play or bouncing surface within the opening. Such a bouncing surface can provide an alternate trampoline rebound surface with the upper inflatable donut-shaped tubular member forming a wall around the rebound surface to prevent users from falling off the rebound surface. Hand and foot holds can be provided in the opening, and, depending upon the size of the inflatable donut-shaped tubular members and the size of the opening therethrough, when the stack of inflatable donut-shaped tubular members is positioned on its side, a user can use such hand and foot holds to stand across the opening, and the inflatable donut-shaped tubular members can be rolled to roll the user within the opening as the inflatable donut-shaped tubular members roll.

In an example embodiment of the invention, the plurality of inflatable donut-shaped tubular members comprises two inflatable donut-shaped tubular members arranged and secured together in stacked configuration, with each of the stacked inflatable donut-shaped tubular members forming separate inflatable air chambers so that the relative inflations of the two stacked inflatable donut-shaped tubular members can be adjusted. With this configuration, a trampoline can be formed with a single one of the inflatable donut-shaped tubular members, preferably the upper inflatable donut-shaped tubular member, inflated to hold the trampoline rebound surface above the supporting surface on which the device is supported, such as on the ground or on a floor, or both inflatable donut-shaped tubular members can be inflated to increase the distance of the trampoline rebound surface above the surface on which the device is supported. Having both inflatable donut-shaped tubular members inflated will also generally provide increased rebound energy for the rebound surface. As long as both inflatable donut-shaped tubular members are fully inflated, or when only one of the inflatable donut-shaped tubular members is used that single inflatable donut-shaped tubular member is fully inflated and the other inflatable donut-shaped tubular member is fully deflated, the rebound surface will be supported in normal rebound position substantially parallel to the supporting surface on which the inflatable donut-shaped tubular members are supported. However, if one or both of the inflatable donut-shaped tubular members are not fully inflated, unless a jump is landed exactly in the center of the rebound surface, the rebound surface will tend to tip toward the side the jump is landed from the center. This may be desirable in some circumstances where it is desired to make the trampoline jumping more difficult. However, in most cases, it will be desirable to keep the rebound surface substantially parallel to the supporting surface. As indicated, this requires that if just one of the inflatable donut-shaped tubular members is to be used for the support, that inflatable donut-shaped tubular member is fully inflated and the second inflatable donut-shaped tubular member is substantially fully deflated. An inflatable donut-shaped tubular member can be fully deflated by opening the inflation valve for the member and forcing substantially all air out of the member or by sucking (vacuuming) substantially all of the air out of the member. While it is currently preferred that for trampoline use, if both of the inflatable donut-shaped tubular members are used for support, both are substantially fully inflated, this may not be usually preferred for walking along the balance beam. When used for balance exercises, it may be desirable to make the balance beam walk more difficult by not fully inflating one of the inflatable donut-shaped tubular member thereby allowing the portion of the balance beam under the walker to sink under each step thereby providing increased balancing exercise.

As a further feature, at least one of the plurality of inflatable donut-shaped tubular members can be provided with securement fittings, such as one or more D-rings, which can be used to secure the plurality of inflatable donut-shaped tubular members in position, such as when the device is used in a body of water, to tow the device, such as when used in a body of water or in snow, or to suspend the device in the air where it can be used, for example, as a swing. It has been found that when suspended from a frame, ceiling, or other overhead support with the rebound surface facing upwardly, the rebound surface provides a support for a child, such as a special needs child, for swinging.

BRIEF DESCRIPTION OF THE DRAWINGS

Additional features and advantages of the invention will be apparent from the detailed description which follows, taken in conjunction with the accompanying drawings, which together illustrate, by way of example, features of particular embodiments of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE ILLUSTRATED EMBODIMENTS

Figure 1:
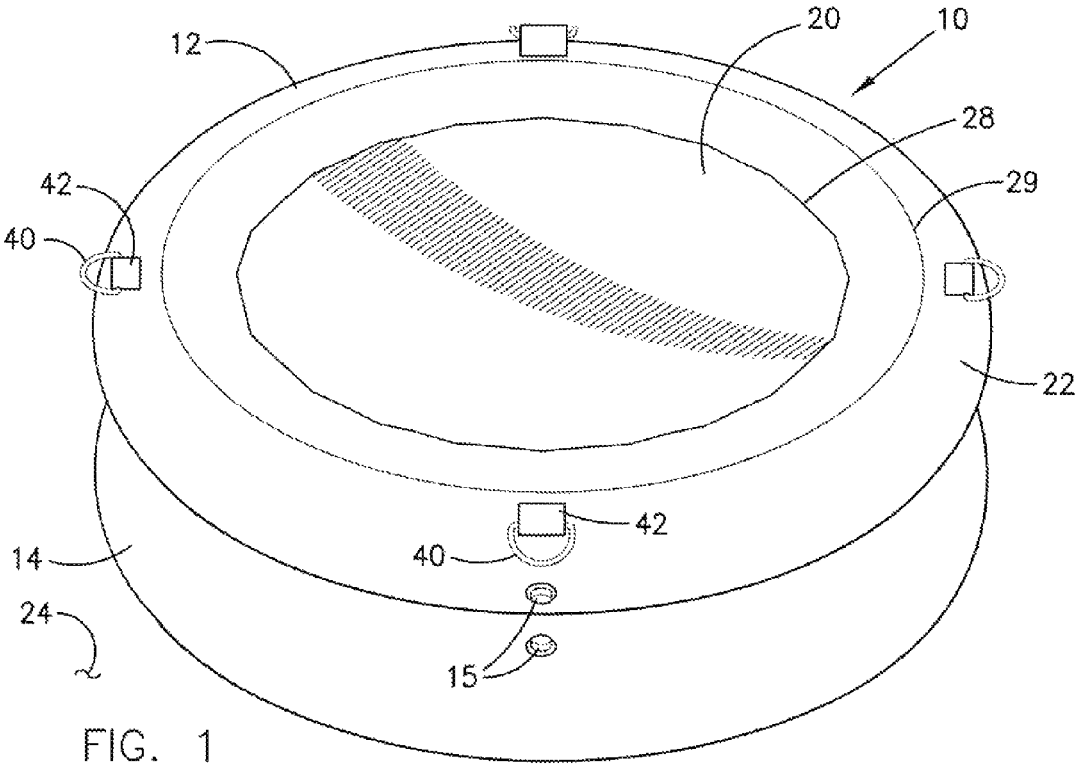
FIG. 1 is a pictorial view of an embodiment of the invention having two stacked inflatable donut-shaped tubular members and with the invention in trampoline mode.
Figure 2:
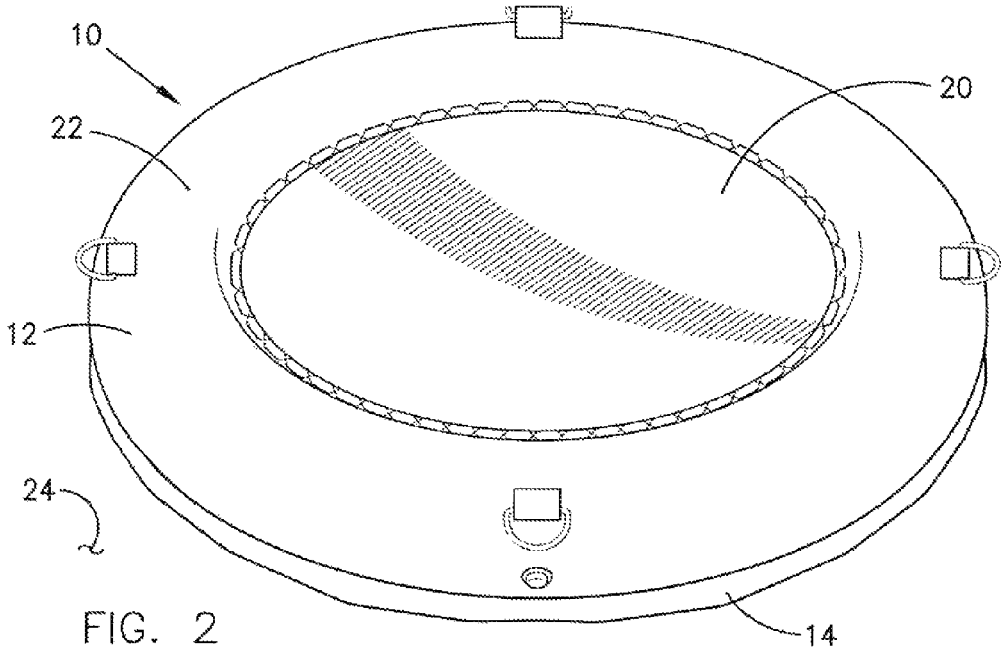
FIG. 2 is a pictorial view of the embodiment of FIG. 1 in trampoline mode, but with the lower one of the two stacked inflatable donut-shaped tubular members completely deflated.
Figure 3:
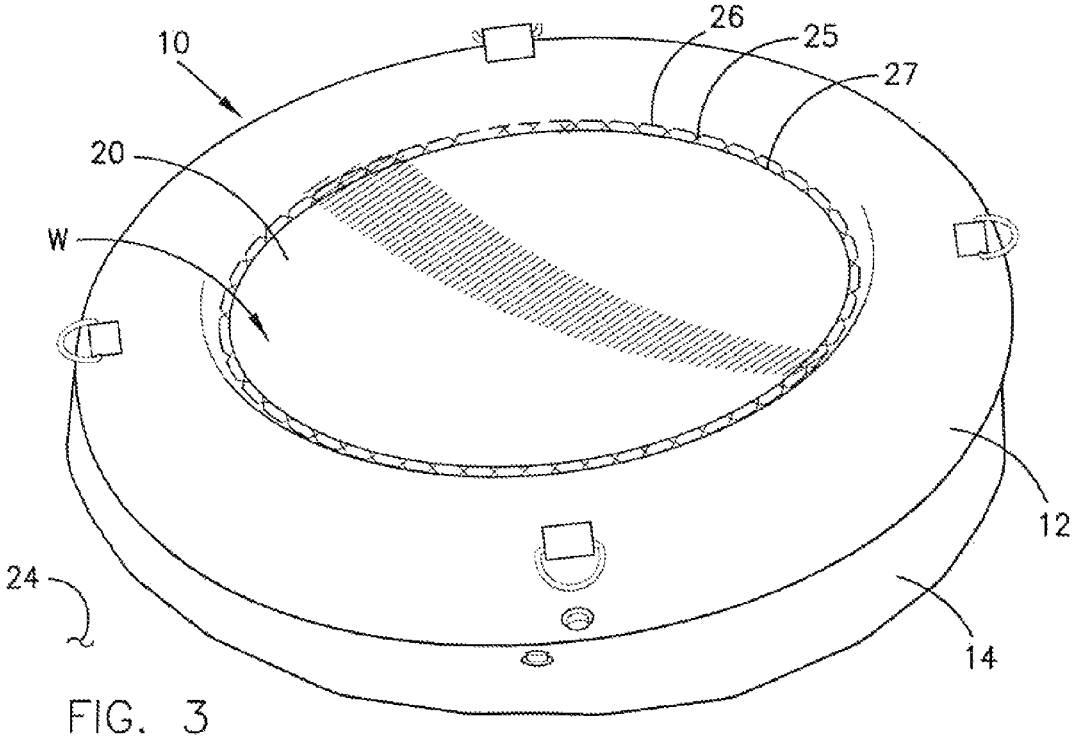
FIG. 3 is a pictorial view of the embodiment of FIG. 1 in trampoline mode, but with the lower one of the two stacked inflatable donut-shaped tubular members partially deflated.
Figure 9:
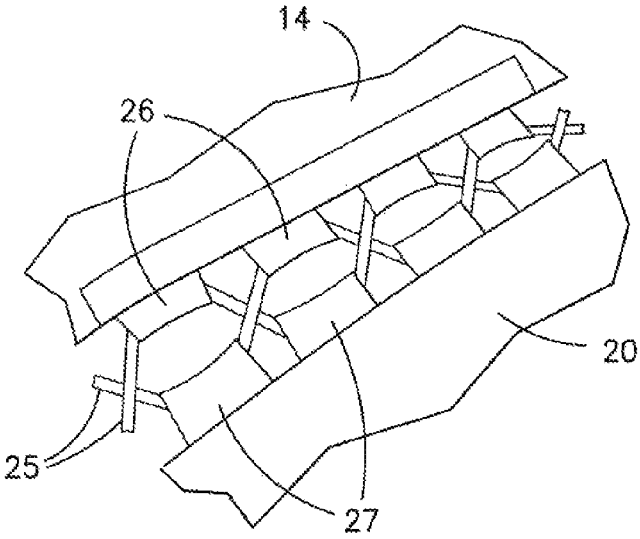
FIG. 9 is a fragmentary pictorial view showing an attachment of the rebound surface for the trampoline to an end of the inflatable donut-shaped tubular member.

The example inflatable recreational device of the invention illustrated in the drawings, indicated generally by reference number 10, includes two inflatable donut-shaped tubular members 12 and 14 secured together in stacked configuration such as shown in FIG. 1. The two inflatable donut-shaped tubular members are separately inflated or deflated such as through respective inflation valves 15. FIG. 1 shows both inflatable donut-shaped tubular members substantially fully inflated. The two inflatable donut-shaped tubular members can be made of various materials, such as supported (fabric reinforced) or unsupported vinyl material, and can be secured together in any suitable manner, such as by plastic welding or adhesives. An opening 16, FIGS. 4, 5, and 6, extends through the two inflatable donut-shaped tubular members 12 and 14. A rebound surface 20, FIGS. 1, 2, and 3, is secured to a first end 22 of the stacked inflatable donut-shaped tubular member 12, to extend over the first end of opening 16. In this manner, rebound surface 20, supported by inflatable donut-shaped tubular members 12 and 14 above a supporting surface, shown as an outdoor ground surface 24, but which could be an indoor floor surface, a water surface, or other supporting surface, forms a trampoline upon which a user can jump when the first end 22 is the top end of the stack so that the rebound surface 20 is facing upwardly. Rebound surface 20 can be secured to the inflatable donut-shaped tubular member 12 in any suitable manner, such as by methods shown in the prior art, or with stretchable bungee cord material 25, FIGS. 3 and 9, laced alternately through tubular member openings formed by tubular member loops 26 secured to the end 22 of inflatable donut-shaped tubular member 12 and rebound surface openings formed by rebound surface loops 27 secured to and extending from rebound surface 20, about its perimeter, as shown in FIGS. 3 and 9. The tubular member openings and the rebound surface openings may be formed in other ways, such as by forming the rebound surface openings with grommets around the perimeter of the rebound surface. The stretchable bungee cord material will add some resilience to the rebound surface. A flexible cover 28, FIG. 1, can be secured to the end 22 of inflatable donut-shaped tubular member 12, such as by gluing or welding along a seam line 29, to extend over and cover the attachment of rebound surface 20 to end 22 of inflatable donut-shaped tubular member 12 to prevent a user from catching a foot between the two when jumping. When both inflatable donut-shaped tubular members 12 and 14 are substantially fully inflated, as shown in FIG. 1, rebound surface 20 is held in substantially stable orientation parallel to the supporting surface 24. In such situation, users jumping on surface 20 will be rebounded substantially vertically upwardly, as is usual when jumping on a trampoline.

Depending upon the size and weight of the users of the trampoline, the bottom inflatable donut-shaped tubular member 14 can be completely deflated as shown in FIG. 2, with rebound surface 20 supported by only the single inflatable donut-shaped member 12, thereby supporting the rebound surface 20 closer to the supporting surface 24. With top inflatable donut-shaped tubular member 12 substantially fully inflated, and with bottom inflatable donut-shaped tubular member 14 substantially completely deflated, the rebound surface 20 is again held in a substantially stable orientation parallel to the supporting surface 24. For smaller users, this is generally a safer configuration for the trampoline since the rebound surface 20 is closer to the supporting surface 24 if the user falls off the rebound surface onto the supporting surface. However, in this orientation, the rebound, i.e., the bounce, provided by the rebound surface 20, is generally less than the rebound or bounce provided by the rebound surface 20 when supported by both inflatable donut-shaped tubular members as shown in FIG. 1. In addition, since the rebound surface is closer to the supporting surface, this configuration should only be used for lighter users as with heavier users, the rebound surface may hit the ground during jumping, which is dangerous. When a single inflatable donut-shaped member can be used as opposed to when both inflatable donut-shaped members should be used will depend upon the size of the inflatable donut-shaped members used and the size and weight of the users.

If one or both of the inflatable donut-shaped tubular members 12 and 14 is only partially inflated, the rebound surface 20 is not held during use in a substantially stable orientation parallel to the supporting surface 24, but can slope under the weight of a user when landing on the rebound surface 20 away from the center of the rebound surface 20. This is because when weight is applied to a portion of the inflatable donut-shaped tubular member which is not substantially fully inflated or substantially fully deflated, air in the member will flow in the member away from the portion to which weight is applied, allowing the portion to which weight is applied to sink, and the portion into which the air flows will expand and rise. This is shown in FIG. 3 where the rebound surface 20 is shown tipped toward the front left of the device resulting from a weight, not shown, applied to the front left of the device indicated generally by W. This situation will make it more difficult to jump on the rebound surface 20, which may provide desirable exercise or training in some situations.

Figure 4:
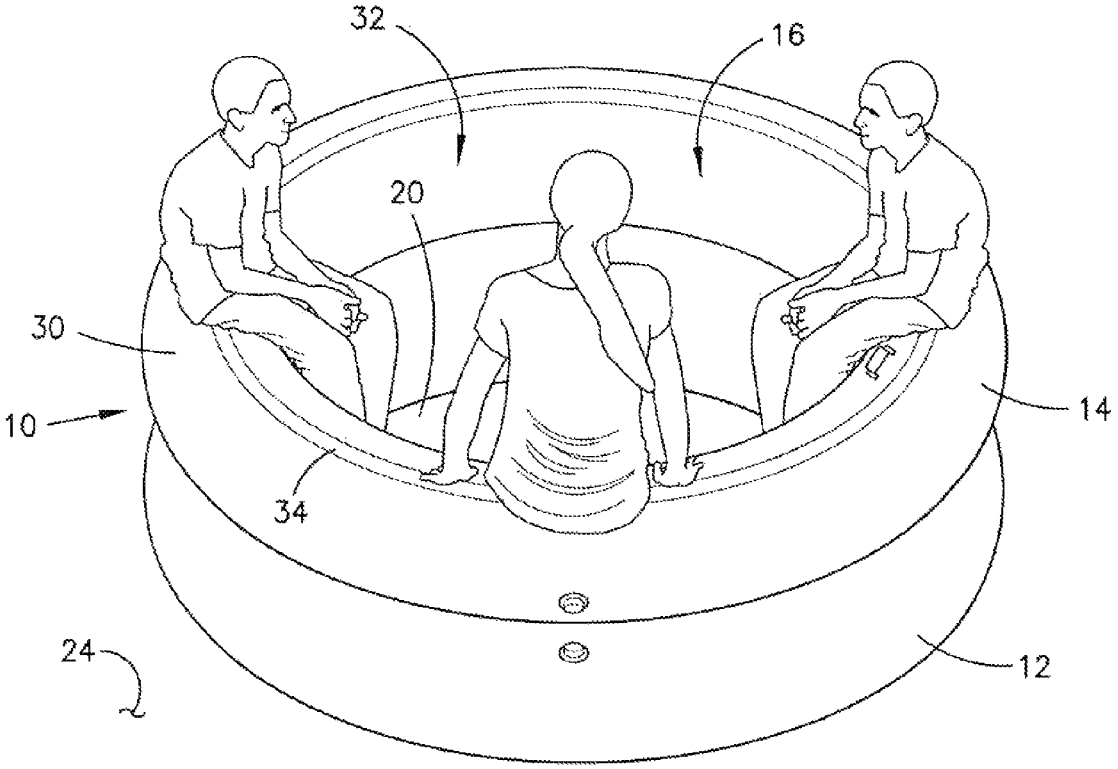
FIG. 4 is a pictorial view of the embodiment of FIG. 1 turned upside down in relation to its position in FIG. 1, showing the opening in the inflatable donut-shaped tubular members facing upwardly with users sitting on the upper inflatable donut-shaped tubular member facing one another with their feet extending into the opening.
Figure 5:
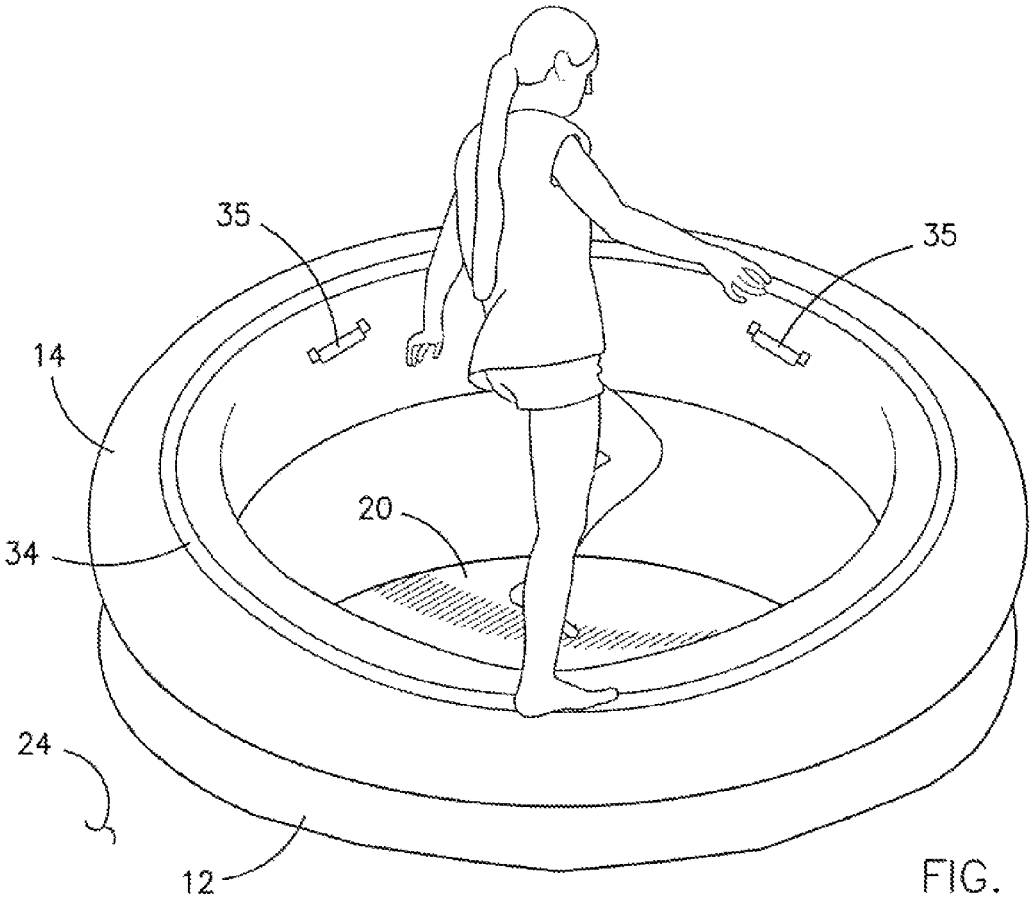
FIG. 5 is a pictorial view of the embodiment of FIG. 1 turned upside down in relation to its position in FIG. 1, similarly to the position shown in FIG. 4, showing the opening in the inflatable donut-shaped tubular members facing upwardly with a user walking along the balance beam indicator on the upper inflatable donut-shaped tubular member.

While the device of the invention 10 in the orientation shown in FIGS. 1, 2, and 3 provides a trampoline, the device can be turned over from the trampoline orientation to move the rebound surface 20 to the bottom of the device as shown in FIGS. 4 and 5 wherein the inflatable donut-shaped tubular member 14 now becomes the top inflatable donut-shaped tubular member and a second end 30 of the device becomes the top of the device. The opening 16 extending through the inflatable donut-shaped tubular members 12 and 14 has an open second end 32, now at the top of the device. Rebound surface 20 is now at the bottom of the device and forms a floor for opening 16, FIG. 4 shows both inflatable donut-shaped tubular members 12 and 14 substantially fully inflated and shows the device forming a gathering place where a plurality of users can gather and sit on the second end 30 of the device facing one another with their legs and feet extending into the opening 16. Further, users can enter the opening 16 and play therein, or can perform balancing exercises by standing on and walking around the top surface of the second end 30, now forming the top end of the device 10.

To aid in the balancing exercises, as shown in FIGS. 4 and 5, a line 34 can be provided around the second end 30, now the top of the device, to represent a balance beam. Each of the inflatable donut-shaped tubular members has a substantially round cross section when substantially fully inflated, The line 34, representing a balance beam, will follow the top crown of the top inflatable donut-shaped tubular member 14. Users can perform balance exercises by walking around the top of the device following the line 34, as shown in FIG. 5. The balance exercise is easier when both inflatable donut-shaped tubular members 12 and 14 are fully inflated as shown in FIG. 4, and is more difficult when one of the inflatable donut-shaped tubular members 12 or 14 is only partially inflated as shown in FIG. 5 where the lower inflatable donut-shaped tubular member 12 is only partially inflated. This partial inflation of inflatable donut-shaped tubular member 12 will allow the top of the device to tilt, as shown in FIG. 5, as a user walks along the balance beam line 34 making balancing on the top of the device more difficult. Depending upon the materials from which the inflatable donut-shaped tubular members 12 and 14 are made, and whether the device 10 of the invention is being used on a hard surface 24, such as the ground or a floor, or in water, i.e., whether the material from which the inflatable donut-shaped tubular members 12 and 14 are made will be slippery for standing and walking thereon, balance beam line 34 can be made of a nonslip material, such as rough surface plastic material or paint, the loop portion of hook and loop fastener material, or a rough vinyl material.

Figure 6:
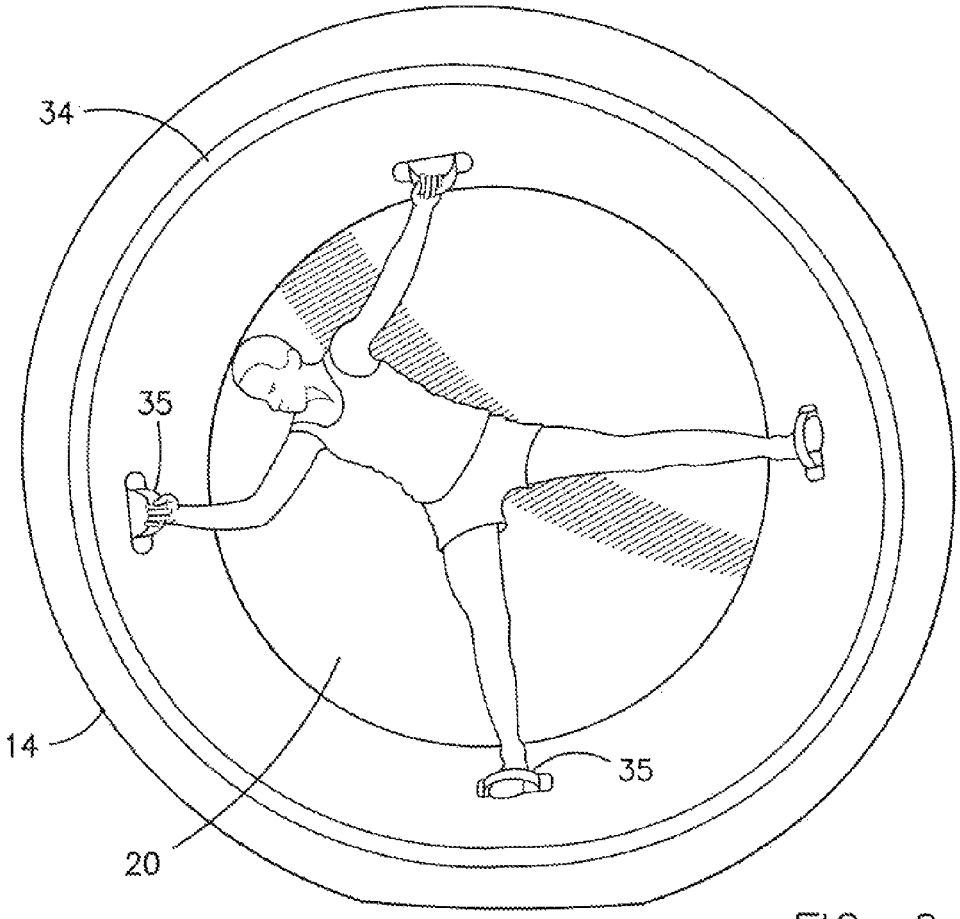
FIG. 6 is a top view of the device of FIG. 1 which is turned on its side so it can be rolled along the supporting surface, such as the ground or floor, and showing a user positioned in the opening therethrough.

Handles 35, which can also be used as foot holds, can be provided at various locations on the inflatable donut-shaped tubular members 12 and 14. For example, four handles 35 can be provided spaced around opening 16 as shown in FIGS. 5 and 6, which provide hand and foot holds as shown in FIG. 6 for a user to stand in opening 16 when the device is oriented on its side as shown in FIG. 6. Since device 10 includes two stacked inflatable donut-shaped tubular members 12 and 14, which, when oriented on its side, provides two side-by-side inflatable donut-shaped tubular members 12 and 14, device 10 of the invention will stand on its side so can be rolled on its side to roll the user positioned inside opening 16 along with the device 10. Handles can be provided in other locations on the inflatable donut-shaped tubular members 12 and 14 and can be used to help users mount the device and/or climb into and out of opening 16.

The inflatable donut-shaped tubular members 12 and 14 of the device can be made in various sizes. In the embodiment shown in FIGS. 2-6, each of the inflatable donut-shaped tubular members 12 and 14 can be formed of inflatable tubes of about sixteen inch diameter when fully inflated, and of length to make a ninety-six inch outside diameter donut. This will then provide a device with a height of about thirty-two inches when fully inflated (two stacked inflatable tubes each about sixteen inches in height) having an opening therethrough about sixty four inches in diameter. A smaller size version of the device, as shown in FIG. 1, can be formed of tubes of about nine inch diameter when fully inflated, and of length to make about a sixty inch outside diameter donut. This will then provide a device with a height of about eighteen inches having an opening of about forty two inches. If a user has both a large version of the device and a smaller version of the device, when the larger device is oriented with the second end 30 and the open end of the opening 16 (earlier herein referred to as the second end 32 of opening 16) facing upwardly, the smaller version of the device, indicated with reference number 36 in FIG. 7, can be inserted into the opening 16, as shown in FIG. 7, with the trampoline rebound surface, indicated with reference number 37 in FIG. 7, facing upwardly to thereby provide a trampoline rebound surface 37 in opening 16 wherein a user can jump on such surface, or otherwise play on such surface, within the protection of the upper portion of opening 16 to prevent such user from falling off the surface.

Figure 8:
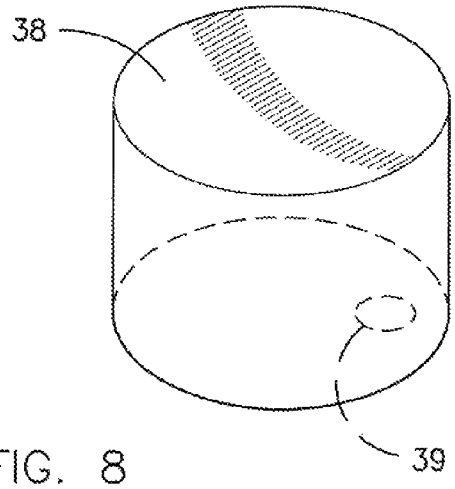
FIG. 8 is a pictorial view of an alternate embodiment of an inflatable air filled structure insertable into the opening through the inflatable donut-shaped tubular members to provide a play or bouncing surface within the opening.
Figure 7:
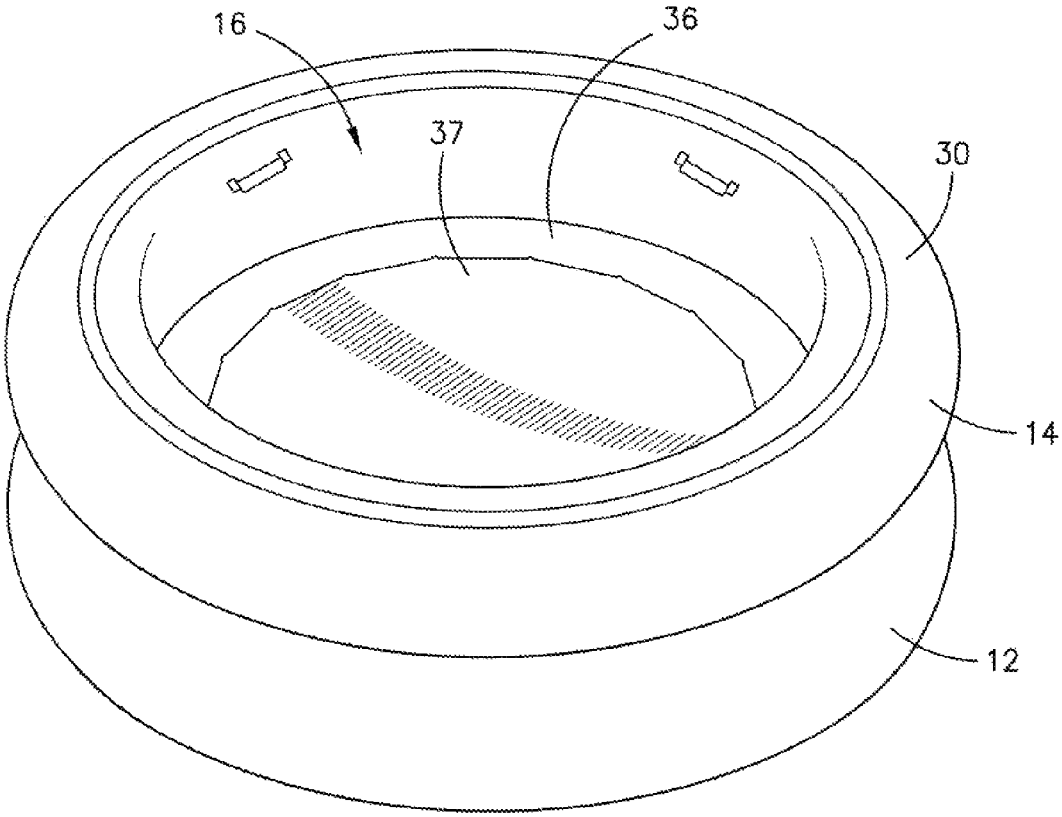
FIG. 7 is a pictorial view similar to that of FIG. 4 showing an inflatable play or bouncing structure inserted into the opening through the inflatable donut-shaped tubular members to provide a play or bouncing surface within the opening.

While, as described above, an inflatable play or bouncing surface can be provided in opening 16 of a device of the invention by providing a smaller device of the invention which is inserted into opening 16, as shown in FIG. 7, a play and bouncing surface can be provided in other ways, such as by inserting a single cylindrical inflated body into opening 16 to provide the play and jumping surface in opening 16. FIG. 8 shows a simple cylindrical inflatable structure 38 which can be inflated through an inflation valve 39 shown schematically in hidden lines on the bottom surface of the structure 38, which structure, when inflated, can be inserted into opening 16 of a device of the invention to provide the play and bouncing surface in opening 16. The diameter of the inflatable structure 38 will be such as to fit relatively snugly into the opening 16 of a particular size and the height of the inflatable structure will be such as to place the top surface of the structure within opening 16 similarly as shown in FIG. 7. Inflatable structures 38 can be sized for and supplied with particular sizes of the device of the invention.

Figure 10:
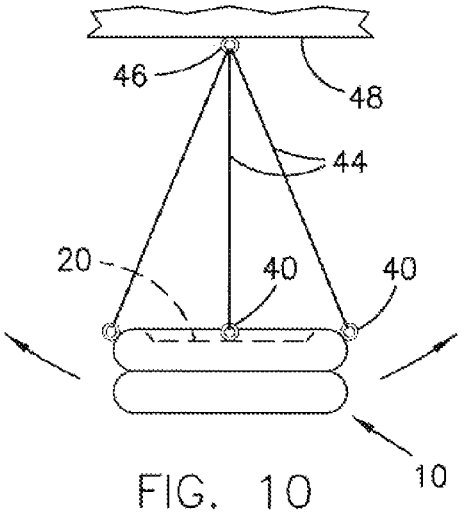
FIG. 10 is a side elevation of a device of the invention suspended from an overhead support to provide a swing.
Figure 11:
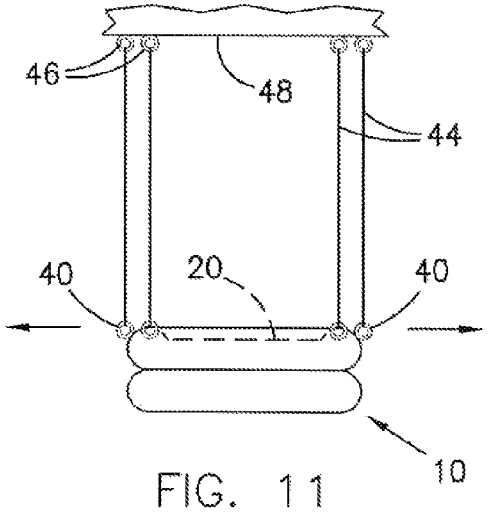
FIG. 11 is a side elevation of a device of the invention suspended in a different way from an overhead support to provide a swing.

The device of the invention can be provided with securement fittings, such as one or more D-rings 40, FIG. 1, spaced around the device. The D-rings 40 may, for example, be secured to an inflatable donut-shaped tubular member, such as the inflatable donut-shaped tubular member 12, in any suitable manner, such as by a patch of reinforced vinyl material 42 glued to a surface of the inflatable donut-shaped tubular member as shown in FIG. 1. Such securement fittings can be used for a variety of purposes, such as to secure the device of the invention in position, as when the device is used in a body of water, with a securement not shown, extending from one or more of the D-rings to a buoy, anchor, or other attachment device, or to tow the device, such as when used in a body of water or on snow, with a securement line extending from one or more of the D-rings to a person pulling the device or to a motorized vehicle such as a boat or snowmobile. It has been found particularly advantageous to use the securement fittings to suspend the device from a frame, ceiling, or other overhead support where it can be used, for example, as a swing. FIG. 10 shows a device 10 of the invention suspended in the air by four support lines 44 extending from respective b-rings 40 to a hook 46 secured in an over head support 48, such as a ceiling or roof beam, wherein the suspended device 10 can be used as a swing. Rebound surface 20 is shown facing upwardly, which provides a surface for a user to lie or sit on during swinging. This has been found to work well for special needs children. FIG. 11 shows the device suspended with each of the four support lines 44 extending from respective D-rings 40 to a different hook 46 so that the device of the invention swings similarly to a glider swing with the upper rebound surface 20 remaining substantially level during swinging to better hold a special needs child thereon.

While the forgoing examples are illustrative of the principles of the present invention in one or more particular applications, it will be apparent to those of ordinary skill in the art that numerous modification in form, usage and details of implementation can be made without the exercise of inventive faculty, and without departing from the principles and concepts of the invention. Accordingly, it is not intended that the invention be limited, except as by the claims set forth below.

The invention claimed is:

1. An inflatable recreation device comprising:

a plurality of inflatable donut-shaped tubular members secured in stacked configuration and having an opening extending therethrough;

a rebound surface secured to a first end of the plurality of stacked inflatable donut-shaped tubular members so as to extend over a first end of the opening, said rebound surface forming a surface upon which a user can jump when the plurality of stacked inflatable donut-shaped tubular members are oriented with the rebound surface facing upwardly;

said device adapted to be turned over whereby the plurality of stacked inflatable donut-shaped tubular members are oriented, with the rebound surface facing downwardly and with a second end of the plurality of stacked inflatable donut-shaped tubular members and a second end of the opening facing upwardly with the rebound surface forming a bottom for the opening; and a balance beam line on the second end of the stacked inflatable donut-shaped tubular members defining a balance beam exercise walking path when the second end of the plurality of inflatable donut-shaped tubular members is facing upwardly.

2. An inflatable recreation device according to claim 1, wherein the balance bow line on the second of the stacked inflatable donut-shape tubular members provides a non slip walking surface along the balance beam line.

3. An inflatable recreation device according to claim 1, wherein the plurality of stacked inflatable donut-shaped tubular members is two inflatable donut-shaped tubular members.

4. An inflatable recreation device according to claim 1, additionally including at least one securement fitting, secured to the device.

5. An inflatable recreation device according to claim 4, wherein the at least one securement fitting is a D-ring.

6. An inflatable recreation device according to claim 4, wherein the at least one securement fitting is a plurality of securement fittings positioned with respect to the device to enable the device to be suspended as a swing by attaching respective support lines to the plurality of securement fittings.

7. An inflatable recreation device according to claim 1, wherein the rebound surface is secured to the first end of the plurality of stacked inflatable donut-shaped tubular members by a length of stretchable elastic material laced between the rebound surface and the first end of the plurality of stacked inflatable donut-shaped tubular members.

8. An inflatable recreation device according to claim 7, wherein the rebound surface has a perimeter and a plurality of rebound surface openings associated with the perimeter through which the stretchable elastic material passes.

9. An inflatable recreation device according to claim 8, wherein the plurality of rebound surface openings are formed by a plurality of loops extending from the rebound surface.

10. An inflatable recreation device according to claim 9, wherein the first end of the plurality of stacked inflatable donut-shaped tubular members includes a plurality of tubular member loops extending therefrom to farm openings through which the stretchable elastic material passes, said stretchable elastic material passing alternately through rebound surface loops and tubular member loops.

11. An inflatable recreation device comprising:

a plurality of inflatable donut-shaped tubular members secured in stacked configuration and having an opening extending therethrough;

a rebound surface secured to a first end of the plurality of stacked inflatable donut-shaped tubular members so as to extend over a first end of the opening, said rebound surface forming a surface upon which a user can jump when the plurality of stacked inflatable donut-shaped tubular members are oriented with the rebound surface facing upwardly;

said device adapted to be turned over whereby the plurality of stacked inflatable donut-shaped tubular members are oriented with the rebound surface facing downwardly and with a second end of the plurality of stacked inflatable donut-shaped tubular members and a second end of the opening facing upwardly with the rebound surface forming a bottom for the opening;

wherein the device is adapted to be turned on its side, and additionally including handles forming at least a pair of handholds and a pair of footholds for holding the hands and feet of a user during rolling of the plurality of inflatable donut-shaped tubular members on its side.

12. An inflatable recreation device according to claim 11, wherein the plurality of stacked inflatable donut-shaped tubular members is two inflatable donut-shaped tubular members.

13. An inflatable recreation device according to claim 11, additionally including at least one securement fitting secured to the device.

14. An inflatable recreation device according to claim 13, wherein the at least one securement fitting is a plurality of securement fittings positioned with respect to the device to enable the device to be suspended as a swing by attaching respective support lines to the plurality of securement fittings.

15. An inflatable recreation device comprising:

a plurality of inflatable donut-shaped tubular members secured in stacked configuration and having an opening extending therethrough;

a rebound surface secured to a first end of the plurality of stacked inflatable donut-shaped tubular members so as to extend over a first end of the opening, said rebound surface forming a surface upon which a user can jump when the pluralitv of stacked inflatable donut-shaped tubular members are oriented with the rebound surface facing upwardly;

said device adapted to be turned over whereby the plurality of stacked inflatable donut-shaped tubu1ar members are oriented with the rebound surface facing downwardly and with a second end of the plurality of stacked inflatable donut-shaped tubular members and a second end of the opening facing upwardly with the rebound surface forming a bottom for the opening; and an inflatable play or bouncing structure removably insertable into the second end of the opening when the second end of the plurality of stacked inflatable donut-shaped tubular members is facing upwardly to provide a play or bouncing surface in the opening.

16. An inflatable recreation device according to claim 15, wherein the inflatable play or bouncing structure removably inserted into the second end of the opening comprises a plurality of bouncing structure inflatable donut-shaped tubular members of a size to fit into the opening secured in stacked configuration and having a bouncing structure opening extending therethrough and a bouncing surface secured to a first end of the plurality of stacked bouncing structure inflatable donut-shaped tubular members so as to extend over a first end of the bouncing structure opening, said bouncing surface forming a bouncing surface upon which a user can jump when the plurality of stacked bouncing structure inflatable donut-shaped tubular members are removably inserted into the second end of the plurality of stacked inflatable donut-shaped tubular members with the bouncing Surface facing upwardly within the opening.

17. An inflatable recreation device according to claim 15, wherein the inflatable play or bouncing structure is an inflatable cylindrical structure.

18. An inflatable recreation device according to claim 15, wherein the plurality of stacked inflatable donut-shaped tubular members is two inflatable donut-shaped tubular members.

19. An inflatable recreation device according to claim 15, additionally including at least one securement fitting secured to the device.

20. An inflatable recreation device according to claim 19, wherein the at least one securement fitting is a plurality of securement fittings positioned with respect to the device to enable the device to be suspended as a swing by attaching respective support lines to the plurality of securement fittings.

* * * * *